US007272334B2

(12) United States Patent
Moore et al.

(10) Patent No.: US 7,272,334 B2
(45) Date of Patent: Sep. 18, 2007

(54) IMAGE ON PAPER REGISTRATION ALIGNMENT

(75) Inventors: Steven R. Moore, Rochester, NY (US); Stan Alan Spencer, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/095,378

(22) Filed: Mar. 31, 2005

(65) Prior Publication Data

US 2006/0222384 A1 Oct. 5, 2006

(51) Int. Cl.
*G03G 15/00* (2006.01)

(52) U.S. Cl. ..... 399/72; 399/49; 399/394

(58) Field of Classification Search ..... 399/39, 399/72, 49, 391, 394
See application file for complete search history.

(56) References Cited

U.S. PATENT DOCUMENTS

| | | | |
|---|---|---|---|
| 4,579,466 | A | 4/1986 | Sato |
| 4,587,532 | A | 5/1986 | Asano |
| 4,836,119 | A | 6/1989 | Siraco |
| 5,080,340 | A | 1/1992 | Hacknauer |
| 5,095,342 | A | 3/1992 | Farrell |
| 5,159,395 | A | 10/1992 | Farrell |
| 5,208,640 | A | 5/1993 | Horie |
| 5,272,511 | A | 12/1993 | Conrad |
| 5,326,093 | A | 7/1994 | Sollitt |
| 5,389,969 | A | 2/1995 | Suzuki |
| 5,435,544 | A | 7/1995 | Mandel |
| 5,473,419 | A | 12/1995 | Russel |
| 5,504,568 | A | 4/1996 | Saraswat |
| 5,525,031 | A | 6/1996 | Fox |
| 5,557,367 | A | 9/1996 | Yang |
| 5,568,246 | A | 10/1996 | Keller |
| 5,570,172 | A | 10/1996 | Acquaviva |
| 5,596,416 | A | 1/1997 | Barry |
| 5,629,762 | A | 5/1997 | Mahoney |
| 5,710,968 | A | 1/1998 | Clark |
| 5,778,377 | A | 7/1998 | Marlin |

(Continued)

OTHER PUBLICATIONS

U.S. Appl. No. 10/761,522, filed Jan. 21, 2004, Mandel et al.

(Continued)

*Primary Examiner*—David M. Gray
*Assistant Examiner*—Joseph S. Wong
(74) *Attorney, Agent, or Firm*—Fay Sharpe LLP; Karl W. Hauber

(57) ABSTRACT

A method is provided for aligning images on media produced by one or more print engines in an integrated print system. The method includes printing a first pattern of first symbols on a first region of a print medium with a first print engine and printing a second pattern of second symbols on a second region of the print medium with at least a second print engine in a manner to superpose the second pattern on the first pattern. The method further includes measuring a first deviation of the second pattern of second symbols relative to the first pattern of first symbols, recording the first deviation as a first offset distance relative to the first print engine, reporting the first offset distance to a controller of the second print engine, and, using the first offset distance for aligning at least the second print engine relative to the first print engine.

17 Claims, 3 Drawing Sheets

U.S. PATENT DOCUMENTS

| | | | |
|---|---|---|---|
| 5,884,910 | A | 3/1999 | Mandel |
| 5,995,721 | A | 11/1999 | Rourke |
| 6,059,284 | A | 5/2000 | Wolf |
| 6,125,248 | A | 9/2000 | Moser |
| 6,241,242 | B1 | 6/2001 | Munro |
| 6,297,886 | B1 | 10/2001 | Cornell |
| 6,384,918 | B1 | 5/2002 | Hubble, III |
| 6,450,711 | B1 | 9/2002 | Conrow |
| 6,476,376 | B1 | 11/2002 | Biegelsen |
| 6,476,923 | B1 | 11/2002 | Cornell |
| 6,493,098 | B1 | 12/2002 | Cornell |
| 6,537,910 | B1 | 3/2003 | Burke |
| 6,550,762 | B2 | 4/2003 | Stoll |
| 6,554,276 | B2 | 4/2003 | Jackson |
| 6,577,925 | B1 | 6/2003 | Fromherz |
| 6,607,320 | B2 | 8/2003 | Bobrow |
| 6,608,988 | B2 | 8/2003 | Conrow |
| 6,612,566 | B2 | 9/2003 | Stoll |
| 6,621,576 | B2 | 9/2003 | Tandon |
| 6,633,382 | B2 | 10/2003 | Hubble, III |
| 6,639,669 | B2 | 10/2003 | Hubble, III |
| 6,819,906 | B1 | 11/2004 | Herrmann |
| 2002/0078012 | A1 | 6/2002 | Ryan |
| 2002/0103559 | A1 | 8/2002 | Gartstein |
| 2003/0077095 | A1 | 4/2003 | Conrow |
| 2004/0085561 | A1 | 5/2004 | Fromherz |
| 2004/0085562 | A1 | 5/2004 | Fromherz |
| 2004/0088207 | A1 | 5/2004 | Fromherz |
| 2004/0150156 | A1 | 8/2004 | Fromherz |
| 2004/0150158 | A1 | 8/2004 | Biegelsen |
| 2004/0153983 | A1 | 8/2004 | McMillan |
| 2004/0213604 | A1* | 10/2004 | Koide ..... 399/299 |
| 2004/0216002 | A1 | 10/2004 | Fromherz |
| 2004/0225391 | A1 | 11/2004 | Fromherz |
| 2004/0225394 | A1 | 11/2004 | Fromherz |
| 2006/0034631 | A1* | 2/2006 | Lofthus et al. ..... 399/84 |

OTHER PUBLICATIONS

U.S. Appl. No. 10/785,211, filed Feb. 24, 2004, Lofthus et al.
U.S. Appl. No. 10/860,195, filed Aug. 23, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/001,890, filed Dec. 2, 2004, Lofthus et al.
U.S. Appl. No. 11/002528, filed Dec. 2, 2004, Lofthus et al.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.

* cited by examiner

IMAGE ON PAPER REGISTRATION ALIGNMENT

CROSS REFERENCE TO RELATED PATENTS AND APPLICATIONS

The following applications, the disclosures of each being totally incorporated herein by reference are mentioned:

U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES," by David G. Anderson, et al.;

U.S. Provisional Application Ser. No. 60/631,656, filed Nov. 30, 2004, entitled "MULTI-PURPOSE MEDIA TRANSPORT HAVING INTEGRAL IMAGE QUALITY SENSING CAPABILITY," by Steven R. Moore;

U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE," by David G. Anderson et al.;

U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE," by David G. Anderson et al.;

U.S. application Ser. No. 10/761,522, filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/860,195, filed Aug. 23, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619, filed Jun. 30, 2004, entitled "FLEXIBLE PAPER PATH USING MULTIDIRECTIONAL PATH MODULES," by Daniel G. Bobrow;

U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, for PRINTING SYSTEM WITH HORIZONTAL HIGHWAY AND SINGLE PASS DUPLEX by Lofthus, et al.;

U.S. application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N. M. deJong, et al.;

U.S. application Ser. No. 10/924,458, filed Aug. 23, 2004 for PRINT SEQUENCE SCHEDULING FOR RELIABILITY by Robert M. Lofthus, et al.;

U.S. patent application Ser. No. 10/924,459, filed Aug. 23, 2004, entitled "PARALLEL PRINTING ARCHITECTURE USING IMAGE MARKING DEVICE MODULES," by Barry P. Mandel, et al;

U.S. patent application Ser. No. 10/933,556, filed Sep. 3, 2004, entitled "SUBSTRATE INVERTER SYSTEMS AND METHODS," by Stan A. Spencer, et al.

U.S. patent application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski et al.;

U.S. application Ser. No. 10/999,326, filed Nov. 30, 2004, entitled "SEMI-AUTOMATIC IMAGE QUALITY ADJUSTMENT FOR MULTIPLE MARKING ENGINE SYSTEMS," by Robert E. Grace, et al.;

U.S. patent application Ser. No. 10/999,450, filed Nov. 30, 2004, entitled "ADDRESSABLE FUSING FOR AN INTEGRATED PRINTING SYSTEM," by Robert M. Lofthus, et al.;

U.S. patent application Ser. No. 11/000,158, filed Nov. 30, 2004, entitled "GLOSSING SYSTEM FOR USE IN A TIPP ARCHITECTURE," by Bryan J. Roof;

U.S. patent application Ser. No. 11/000,168, filed Nov. 30, 2004, entitled "ADDRESSABLE FUSING AND HEATING METHODS AND APPARATUS," by David K. Biegelsen, et al.;

U.S. patent application Ser. No. 11/000,258, filed Nov. 30, 2004, entitled "GLOSSING SYSTEM FOR USE IN A TIPP ARCHITECTURE," by Bryan J. Roof;

U.S. application Ser. No. 11/001,890, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/002,528, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/051,817, filed Feb. 4, 2005, entitled "PRINTING SYSTEMS," by Steven R. Moore, et al.;

U.S. application Ser. No. 11/069,020, filed Feb. 28, 2005, entitled "PRINTING SYSTEMS," by Robert M. Lofthus, et al.;

U.S. application Ser. No. 11/070,681, filed Mar. 2, 2005, entitled "GRAY BALANCE FOR A PRINTING SYSTEM OF MULTIPLE MARKING ENGINES," by R. Enrique Viturro, et al.; and, U.S. application Ser. No. 11/081,473, filed Mar. 16, 2005, entitled "MULTI-PURPOSE MEDIA TRANSPORT HAVING INTEGRAL IMAGE QUALITY SENSING CAPABILITY," by Steven R. Moore.

BACKGROUND

The subject exemplary embodiments relate generally to alignment of images onto media produced by print or marking engines included as part of an integrated printing system or integrated parallel printing system. A method is provided for aligning images produced by one or more print engines, such as color and black print engines, which permits accurate and objective determination of the relative misalignment of images from one print engine to another print engine. The present exemplary embodiments relate to media (i.e. document or paper) handling systems and systems for printing thereon and is especially applicable for a printing system comprising a plurality of associated marking engines.

Printing systems including a plurality of marking engines are known and have been generally referred to as tandem engine printers or cluster printing systems. See U.S. Pat. No. 5,568,246. It is typical that different sheets within a document will be produced by different marking engines. Such systems especially facilitate expeditious duplex printing (both sides of a document are printed) with the first side of a document being printed by one of the marking engines and the other side of the document being printed by another so that parallel printing of sequential documents can occur. The process path for the document usually requires an inversion of the document (the leading edge is reversed to become the trailing edge) to facilitate printing on the back side of the document. Inverter systems are well known and essentially comprise an arrangement of nip wheels or rollers which receive the document by extracting it from a main process path, then direct it back on to the process path after a 180° flip so that what had been the trailing edge of the document now leaves the inverter as the leading edge along the main process path. Inverters are thus fairly simple in their functional result; however, complexities occur as the printing system is required to handle different sizes and types of documents and where the marking engines themselves are arranged in a parallel printing system to effect different types of printing, e.g., black only printing versus color or custom color printing.

Within a print engine, a document is typically carefully aligned to the print engine's image formation apparatus. The resultant image on paper (IOP) registration performance of each print engine can contribute to the overall appearance of a document. The geometric parameters that are typically specified for each engine are process, cross process, skew alignment, and magnification. It is therefore important that the system is able to correct for any mean shifts between marking engines for any of these parameters, since in general more than one print engine may contribute printed pages to a single finished document. In an integrated parallel printing system comprised of more than two print engines, providing IOP registration consistency can be complex.

The adjustment of the print engines to desired positions for accurate printing can be referred to as image on paper registration. A test print, to be described in more detail below, can contain alignment targets that show each engine's IOP registration relative to an arbitrary base engine. Periodic monitoring and adjusting of IOP registration is desired as the number of marking engines increases or decreases, and/or when the marking engines become misaligned, for example, due to drift. Adjustment mechanisms and controls which maintain IOP registration between multiple printing engines are highly desired.

SUMMARY

A first aspect of the exemplary embodiments includes a method of aligning images produced by one or more print engines in an integrated print system. The method comprises printing a first pattern of first symbols on a first region of a print medium with a first print engine and printing a second pattern of second symbols on a second region of the print medium with at least a second print engine in a manner to superpose the second pattern on the first pattern. The method further includes measuring a first deviation of the second pattern of second symbols relative to the first pattern of first symbols, recording the first deviation as a first offset distance relative to the first print engine, reporting the first offset distance to a controller of the second print engine, and, using the first offset distance for aligning at least the second print engine relative to the first print engine. The aligning of the at least second print engine can be accomplished using several different methods. The print engine frame can be physically moved, or the print engine's image forming apparatus can be adjusted, or the nominal document position during image receipt can be adjusted. Combinations of these different approaches are also possible.

A second aspect of the exemplary embodiments includes a printing system having a first print engine, a second print engine, and a media path therebetween for transporting media sheets. The media sheets include a test sheet for printing a test pattern thereon from the first print engine and the second print engine. The first print engine can print a first portion of the test pattern and the second print engine can print a second portion of the test pattern. The test sheet includes alignment targets for determining an offset between the first portion and the second portion.

A third aspect of the exemplary embodiments includes a xerographic printing system having a plurality of integrated print engines for printing a test sheet including registration alignment marks thereon. A first print engine can be selected from the plurality of print engines for printing a first portion of a test pattern on the test sheet and a second print engine can be selected from the plurality of print engines for printing a second portion of the test pattern on the test sheet. The printing system further includes a controller for measuring an image on paper registration error between the first portion and the second portion.

DETAILED DESCRIPTION OF THE EXEMPLARY EMBODIMENTS

Figure 1:
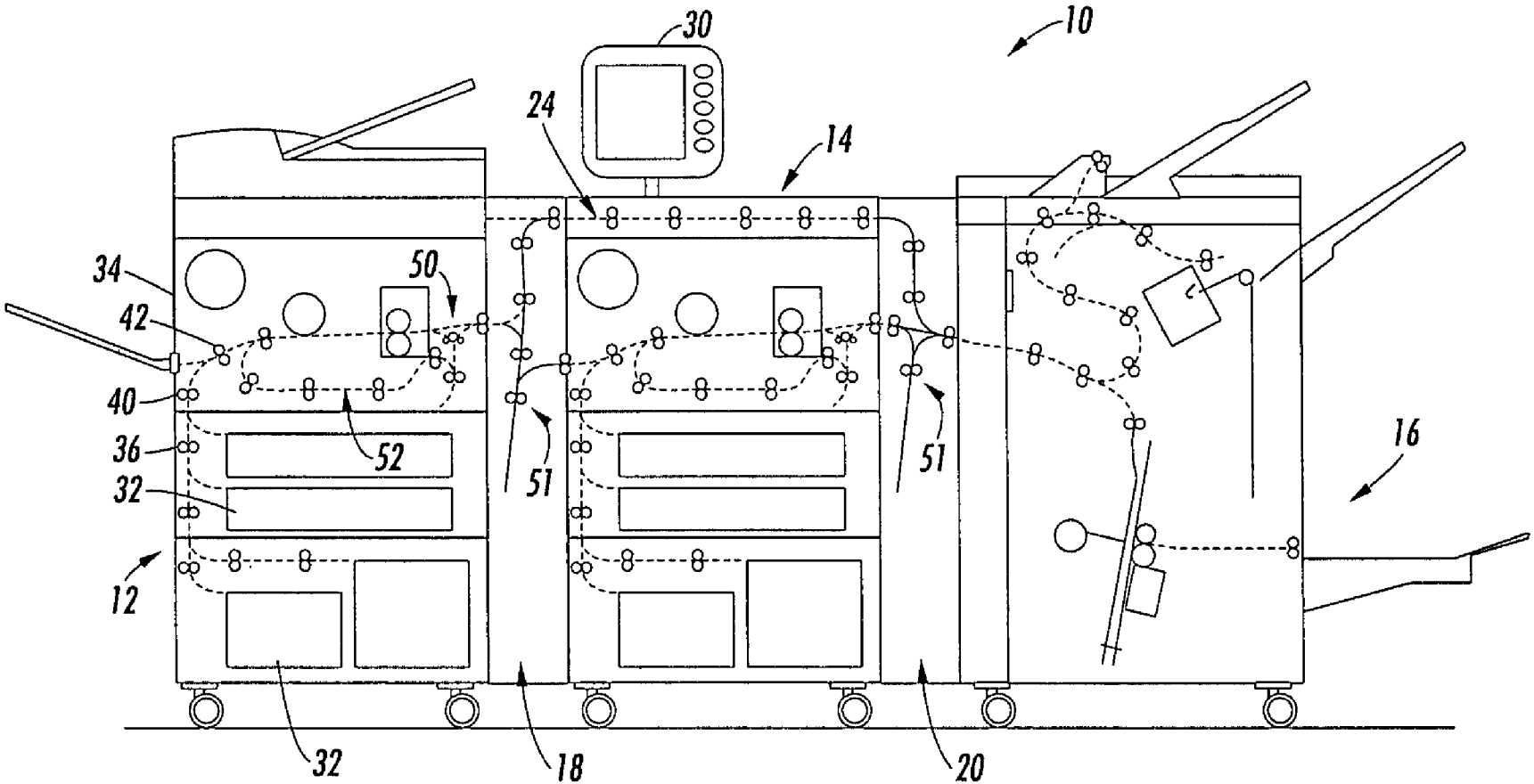
FIG. 1 shows a schematic view of a printing system illustrating selective architectural embodiments of the subject developments.

With reference to the drawings wherein the showings are for purposes of illustrating alternative embodiments and not for limiting same, FIG. 1 shows a schematic view of a printing system comprising a plurality of marking engines associated for tightly integrated parallel printing of documents within the system. More particularly, printing system 10 is illustrated as including primary elements comprising a first marking engine 12, a second marking engine 14, and a finisher assembly 16. Connecting these three elements are three transport assemblies 18, 24 and 20. The document outputs of the first marking engine 12 can be directed either up and over the second marking engine 14 through horizontal by-pass path 24 and then to the finisher 16. Alternatively, where a document is to duplexed printed, the first vertical transport 18 can transport a document via inverter 51 to the second marking engine 14 for duplex printing. The details of practicing parallel simplex printing and duplex printing through tandemly arranged marking engines are known and can be generally appreciated with reference to the foregoing cited U.S. Pat. No. 5,568,246. In order to maximize marking paper handling reliability and to simplify system jam clearance, the marking engines are often run in a simplex mode. The sheets exit the marking engine image-side up so they must be inverted before compiling in the finisher 16. Control station 30 allows an operator to selectively control the details of a desired print job and make adjustments to print engine IOP registration.

The marking engines 12, 14 shown in FIG. 1 are conventional in this general illustration and include a plurality of document feeder trays 32 for holding different sizes of documents that can receive print markings by the marking engine portion 34. The documents are transported to the marking engine portion along a highway path 36 which is common to a plurality of the trays 32. The image transfer zone can be considered to be that portion of the marking engine 34 in which some portion of the sheet is in the process of having an image transferred to it and in some marking engines, fused. Each marking engine 12, 14 is shown to include an inverter assembly 50 conventionally known as useful for duplex printing of a document by the same engine. More particularly, after one side of a document is printed, it is transported to the inverter assembly 50 where it is inverted and then communicated back to the image transfer zone by duplex path 52.

Figure 2:
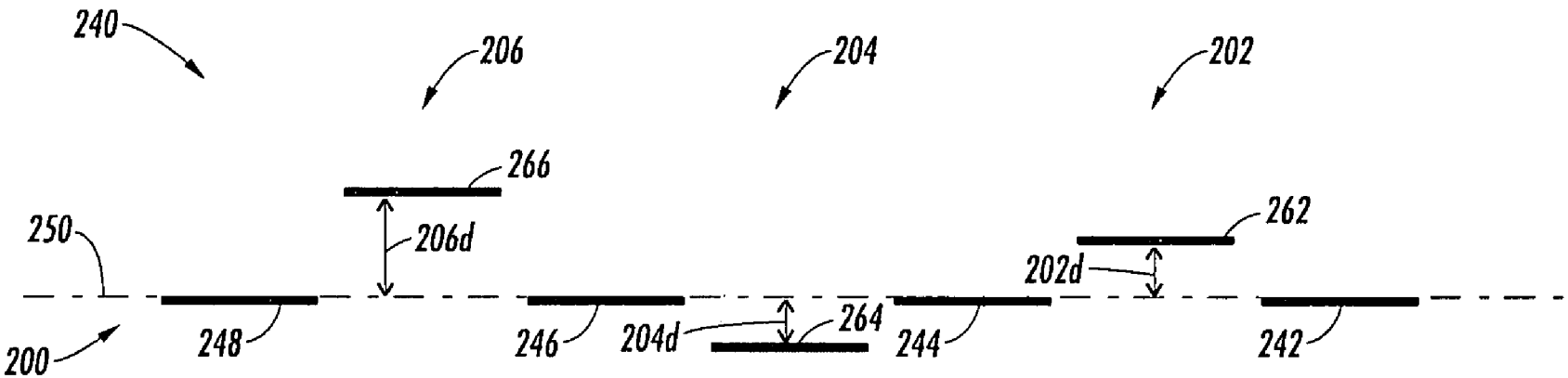
FIG. 2 is a test pattern in accordance with the exemplary embodiments.
Figure 3:
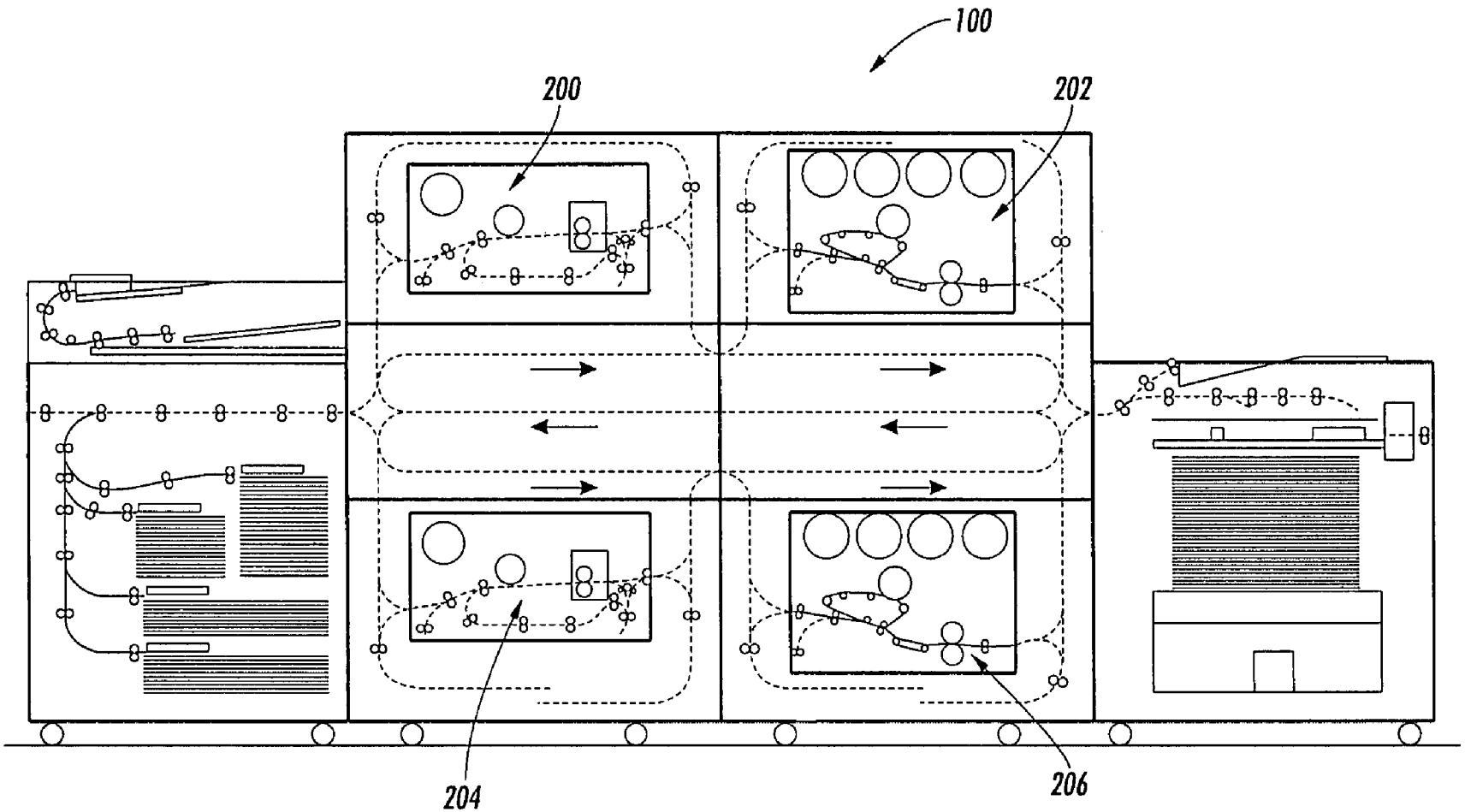
FIG. 3 is a schematic view of a tightly integrated parallel printing system in accordance with the exemplary embodiments.

Referring now to FIGS. 2 and 3, a method and printing system according to the exemplary embodiments proposes a procedure which involves subjecting a test sheet to overprinting by at least a pair of the system's marking engines. It is to be appreciated that the hereinafter described procedure can involve all of the marking engines comprising an integrated parallel printing system whereby IOP registrations from multiple marking engines can be ascertained. IOP registration errors between different print engines can be on the magnitude of, for example, 0.25 to 5.0 mm. A two step alignment process can include a first step which aligns an image from a base engine 200 to the corresponding sheet edges. The second step can selectively align the other engines 202, 204, 206 in the system relative to the base engine 200. If an Image Input Terminal (IIT) or internal image quality sensor is employed, it is possible to perform both alignment steps in parallel rather than serially. It is to be appreciated that engines, for example print engines 200 and 204, having the same marking capability (i.e. monochrome) can be aligned to one another so that output from each engine looks consistent within a document. The overprinting feature can be used to create the alignment test print even if this does not comprise a normal print mode (i.e. a system having two identical monochrome engines can have their relative side 1 to side 2 alignments done with this procedure).

Referring now to FIG. 2, a sample test print or pattern 240 is therein shown for exemplary purposes. FIG. 2 displays a series of alignment marks. Other marks are contemplated within the scope of the exemplary embodiments. In this example, engine 200 has been identified as the base or first engine and it creates a series of first patterns of first symbols or reference markers (i.e. alignment targets) 242, 244, 246, 248, thereby establishing a baseline 250. Engines 202, 204, 206 can then print complementary sets of patterns of symbols or images 262, 264, 266 superposed with the first pattern of symbols 242, 244, 246, 248. The relative error of each marking engine 202, 204, 206 relative to engine 200, can then be represented by the vertical deviation of each line segment 202*d*, 204*d*, 206*d* from the baseline 250 established by engine 200. Either an operator (or user interface), the IIT, or an image quality sensor (not illustrated) can then determine the amount of error and report this amount to a controller (not shown) of each marking engine 200, 202, 204, 206 for correction. In the displayed example of FIG. 2, the system can have the following errors reported back to the controllers:

marker 200 to sheet=−1.0 mm;
marker 202 to marker 200=+0.5 mm; (202*d*)
marker 204 to marker 200=−0.5 mm; and, (204*d*)
marker 206 to marker 200=+1.0 mm. (206*d*)

The above errors can be reported, respectively, to each engine's controller, which can then make an adjustment in an opposite sense to the measured error. It is to be appreciated that each relative 'marker to marker' correction will also have the absolute 'marker 200 to sheet' correction superimposed onto it. A check print can be optionally run after adjustments have been made to confirm the corrections. A similar pattern can be used to characterize both process and cross process errors and can characterize skew error as well if redundant patterns are placed in at least two corners of the sheet. Furthermore, by placing similar patterns at all four corners of the sheet, it is possible to characterize overall image size (magnification) error of each print engine. It is to be appreciated that this correction process is particularly suited to remove IOP errors that are constant or time-invariant between print engines. Such constant errors, or offsets, may result from accumulated part tolerances within the system.

The method for aligning one or more print engines in an integrated print system generally follows the steps outlined below. The system initiates diagnostic mode either by the operator, after a predeterminable period of time, and/or after the addition/removal of one or more print engines. A test sheet is introduced into the system and each print engine that is to be registered prints a pattern of symbols and successively overlays the pattern onto the sheet. The resultant output can be as shown in FIG. 2. The IOP registration diagnostic test print 240 is thereby generated by the printing system. The test print 240 can be a simplex sheet which is printed upon by all marking engines in the system in a serial manner. The test print contains alignment targets that show each engine's IOP registration relative to an arbitrary base engine. Typically, the base engine 200 is designated as the first one printing the baseline 250 of the test print 240. The relative IOP registration error or deviation between each engine and the base engine can then be measured either by human eye (technician or customer), the system's IIT, or the system's internal image quality sensor. The relative errors 202*d*, 204*d*, 206*d* are fed back to each marking engine so as to drive the mean relative error to zero. The test sheet can be run and purged from the system before, during, or after a print job.

The particular steps involved in the aforementioned method of aligning one or more of the print engines, relative to a base print engine, includes printing a first pattern or baseline 250 of first symbols 242, 244, 246, 248 on a first region of a print medium with a first print engine 200. Next a second pattern of second symbols 262 is printed on a second region of the print medium with at least a second print engine in a manner to superpose the second pattern 262 on the first pattern 250. A first deviation 202*d* of the second pattern of second symbols 262 relative to the first pattern of first symbols is measured. The first deviation 202*d* is recorded as a first offset distance relative to the first print engine 200. The first offset distance is reported to a controller of the second print engine 202. The first offset distance 202*d* can then be utilized for aligning the second print engine 202 relative to the first print engine 200. The method further includes printing a third pattern of third symbols 264 on a third region of the print medium with at least a third print engine 206 in a manner to superpose the third pattern 264 on the first pattern. A second deviation 204*d* of the third pattern of third symbols 264 can then be measured relative to the first pattern of first symbols 250. The second deviation 204*d* is recorded as a second offset distance relative to the first print engine 200. The second offset distance is reported to a controller of the third print engine 204. The second offset distance 204*d* can then be utilized for aligning the third print engine 204 relative to the first print engine 200. The aforementioned steps can be repeated for each print engine in the system. The deviations can be geometric variables representing the amount of process, cross process, skew, or magnification deviation. The base or first print engine can be any one selected from the integrated group of print engines. It is to be appreciated that the aligning of each of the second and third print engines relative to the first print engine can be performed in parallel. It is also to be appreciated that the aligning of the at least second print engine can be accomplished using several different methods. The print engine frame can be physically moved, or the print engine's image forming apparatus can be adjusted, or the nominal document position during image receipt can be adjusted. Combinations of these different approaches are also possible.

Scales (not shown) can be provided as indicia to permit the user to easily determine the amount of misalignment or error. The image on paper registration error is a mean relative error. The operator can input, i.e. via a keypad, the amount of error for a selected print engine(s). The amount of misalignment can then be corrected such that the mean error is driven to zero. This request and the requisite input can be accomplished through the operator interface of control station 30 or other device.

Other print engines can be aligned in a similar manner by printing a separate test pattern or by including other symbols, etc., in test pattern 240 and designating a position for each symbol in a similar manner. The symbols can be differentiated by shape, color, pattern, or the like. The first symbols can be slightly larger than the second symbols. The symbols can be of any shape or size and can be printed in any pattern. The use of substantially the same pattern for the symbols, or in other words a repetitive pattern, is helpful in assisting an observer in picking out the area where one pattern obscures another pattern. Any indicia can be used to designate portions of the test pattern.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method for parallel printing comprising:

printing a first pattern of first symbols on a first region of a print medium with a first print engine;

printing a second pattern of second symbols on a second region of the print medium with at least a second print engine in a manner to superpose the second pattern on the first pattern;

measuring a first deviation of said second pattern of second symbols relative to said first pattern of first symbols;

recording said first deviation as a first offset distance relative to said first print engine;

reporting said first offset distance to a controller of said at least second print engine; and, using said first offset distance for aligning said at least second print engine relative to said first print engine wherein pages printed by said first print engine and pages printed by said at least second print engine are selectively printed in parallel and collated into a final document.

2. The method as recited in claim 1, further comprising:

printing a third pattern of third symbols on a third region of the print medium with at least a third print engine in a manner to superpose the third pattern on the first pattern;

measuring a second deviation of said third pattern of third symbols relative to said first pattern of first symbols;

recording said second deviation as a second offset distance relative to said first print engine;

reporting said second offset distance to a controller of said at least third print engine; and, using said second offset distance for aligning said at least third print engine relative to said first print engine wherein pages printed by said at least third print engine and pages printed by said first print engine are collated into a final document.

3. The method as recited in claim 2 wherein each said first deviation and said second deviation is selected from the group consisting of process, cross-process, skew, and magnification deviation.

4. The method recited in claim 1 wherein printing said second pattern of second symbols is accomplished in a serial manner with printing said first pattern of first symbols.

5. The method as recited in claim 1 wherein said first deviation is selected from the group consisting of process, cross-process, skew, and magnification deviation.

6. The method as recited in claim 1 wherein said first print engine is any one selected from an integrated group of print engines.

7. The method as recited in claim 1 wherein printing of said first pattern and said second pattern is initiated by an operator.

8. The method as recited in claim 1 wherein printing of said first pattern and said second pattern is at predeterminable intervals.

9. A method comprising:

printing a first pattern of first symbols on a first region of a print medium with a first print engine;

printing a second pattern of second symbols on a second region of the print medium with at least a second print engine in a manner to superpose the second pattern on the first pattern;

measuring a first deviation of said second pattern of second symbols relative to said first pattern of first symbols;

recording said first deviation as a first offset distance relative to said first print engine;

reporting said first offset distance to a controller of said at least second print engine;

using said first offset distance for aligning said at least second print engine relative to said first print engine wherein pages printed by said first print engine and pages printed by said at least second print engine are collated into a final document;

printing a third pattern of third symbols on a third region of the print medium with at least a third print engine in a manner to superpose the third pattern on the first pattern;

measuring a second deviation of said third pattern of third symbols relative to said first pattern of first symbols;

recording said second deviation as a second offset distance relative to said first print engine;

reporting said second offset, distance to a controller of said at least third print engine;

using said second offset distance for aligning said at least third print engine relative to said first print engine wherein pages printed by said at least third print engine and pages printed by said first print engine are collated into a final document; and, wherein aligning each of said at least said second print engine and said third print engine to said first print engine is performed in parallel.

10. A xerographic printing system comprising:

a plurality of integrated parallel print engines;

a test sheet including registration alignment marks;

a first print engine selected from said plurality of print engines for printing a first portion of a test pattern on said test sheet;

at least a second print engine from said plurality of print engines for printing a second portion of said test pattern on said test sheet; and, the printing system includes a controller for measuring an image on paper registration error between said first portion and said second portion.

11. The printing system of claim 10, wherein said image on paper registration error is a mean relative error.

12. The printing system of claim 11, wherein said controller drives said mean relative error to zero.

13. The printing system of claim 10, wherein said first portion of said test pattern is printed on one side of said test sheet and said second portion of said test pattern is printed on same said one side of said test sheet.

14. The printing system of claim 10, wherein said error is a geometric error selected from the group consisting of process, cross process, skew, and magnification deviation.

15. The printing system of claim 10, wherein said controller records said image on paper registration error between said first portion and said second portion and aligns said second print engine to said first print engine by said image on paper registration error wherein said aligning is selected from the group consisting of a print engine frame movement, an image forming apparatus adjustment, and a nominal document position.

16. A printing system comprising:

a first print engine, a second print engine, and a media path therebetween for transporting media sheets;

said media sheets include a test sheet for printing a test pattern thereon from said first print engine and said second print engine;

said first print engine prints a first portion of said test pattern and said second print engine prints a second portion of said test pattern;

said test sheet includes alignment targets for determining an offset between said first portion and said second portion wherein pages printed by said first print engine and pages printed by said second print engine are collated into a final document;

a controller records said offset and adjusts said second print engine by said offset thereby aligning said second print engine with said first print engine; and, wherein said aligning is selected from the group consisting of a print engine frame movement, an image forming apparatus adjustment, and a nominal document position.

17. A xerographic parallel printing system comprising:

a plurality of integrated parallel print engines;

a test sheet including registration alignment marks;

a first print engine selected from said plurality of print engines for printing a first portion of a test pattern on said test sheet;

at least a second print engine from said plurality of print engines for printing a second portion of said test pattern on said test sheet;

the printing system includes a controller for measuring an image on paper registration error between said first portion and said second portion; and, wherein the first and second print engines are selected from the group consisting of a monochrome print engine and a color print engine.

* * * * *